United States Patent [19]

Resh

[11] Patent Number: 4,669,396

[45] Date of Patent: Jun. 2, 1987

[54] PELLET BURNING SYSTEM

[75] Inventor: Dale R. Resh, Oshtemo Township, Kalamazoo County, Mich.

[73] Assignee: Leaders Heat Products, Mattawan, Mich.

[21] Appl. No.: 782,253

[22] Filed: Sep. 30, 1985

[51] Int. Cl.[4] ..... F23B 7/00

[52] U.S. Cl. ..... 110/233; 110/101 CF; 110/110; 110/246; 110/294

[58] Field of Search ..... 110/233–235, 110/246–248, 256, 259, 266, 286, 293, 294, 298–300, 101 C, 101 CF, 102, 110, 118, 166

[56] References Cited

U.S. PATENT DOCUMENTS

| | | | |
|---|---|---|---|
| 4,408,547 | 10/1983 | Autere | 110/234 |
| 4,450,776 | 5/1984 | Stevenson | 110/233 |
| 4,454,828 | 6/1984 | Zempel | 110/248 |
| 4,517,903 | 5/1985 | Richmond et al. | 110/233 |

*Primary Examiner*—Albert J. Makay
*Assistant Examiner*—Steven E. Warner
*Attorney, Agent, or Firm*—Flynn, Thiel, Boutell & Tanis

[57] ABSTRACT

A furnace housing having a heat exchanger, an exhaust gas flue and an ash collecting bin therein. A burn chamber is provided in the housing with the heat exchanger being oriented in heat exchanging relation to the burn chamber. An inclined conduit extends through a wall in the furnace housing and terminates in the burn chamber. A rotatable shaft is attached to a burn basket having a bottom wall and a perforate side wall and an open top. The end of the conduit in the burn chamber terminates adjacent the open top of the burn basket. A closed housing is connected to an end of the conduit remote from the end in the burn chamber. A fan delivers air to the closed housing and then to the conduit. A pelletized fuel feeding apparatus delivers pelletized fuel from a storage device to the closed housing and then to the burn basket. A control arrangement drives the burn basket for rotation, regulates the volume of air delivered to the conduit and then to the burn chamber and regulates the volume of pelletized fuel per unit of time to the conduit.

5 Claims, 3 Drawing Figures

PELLET BURNING SYSTEM

FIELD OF THE INVENTION

This invention relates to furnaces and, more particularly, to a pellet burning system for use as a furnace or in supplementing the heat produced by a gas or oil burning furnace.

BACKGROUND OF THE INVENTION

The so-called "bio-mass pellets" have become a popular fuel in the recent past, especially in the northern and western parts of the United States, largely because of their economy, availability and high potential heat content per unit mass. These pellets vary somewhat in configuration but generally constitute cylinders approximately one-fourth inch in diameter and of random lengths averaging approximately three-quarters of an inch. The pellets are formed of organic material, generally of vegetative origin and reasonable homogeneous nature, that has been finely particulated and thereafter compresses to form the configurationally stable pellets. The pellets popularly in vogue are formed substantially from wood products, quite commonly of about 60% tree bark and 40% clean wood chips or sawdust, all by-products of the lumber industry. The composition of the pellets may vary widely through a broad spectrum of combustible organize materials including brush, leaves vegetative and cereal waste and even manure from domestic animals. The pellet burning system disclosed herein is especially adapted for the burning of such bio-mass pellets.

In addition, I have discovered that my system will also burn kernels of corn.

The objects and purposes of my invention include the provision of a method of burning pelletized fuel and a pellet burning system for burning pelletized fuel, including kernels of corn.

It is a further object of my invention to provide a method and a pellet burning system, as aforesaid, which is simple in construction and, therefore, easy to maintain in operating condition.

It is a further object of the invention to provide a method and a pellet burning system, as aforesaid, wherein control structure is provided for maintaining ignition and continuous burn of the fuel added to the system even during times wherein the thermostat condition has been satisfied and that there is no further demand for heat.

SUMMARY OF THE INVENTION

In general, the objects and purposes of the invention are met by providing a furnace housing having a heat exchanger, an exhaust gas flue and an ash collecting bin therein. A burn chamber is provided in the housing above the ash collecting bin, the heat exchanger being oriented in heat exchanging relation to the burn chamber and intermediate the burn chamber and the flue. A conduit extends through a wall in the furnace housing and terminates at an end in the burn chamber. The conduit is inclined to the horizontal. A shaft is provided and it is rotatably supported. A burn basket having a bottom wall and a perforate side wall and an open top is oriented in the burn chamber with the bottom wall being oriented generally perpendicular to a longitudinal axis of the conduit. The end of the conduit in the burn chamber terminates adjacent the open top of the burn basket and is spaced from the bottom wall. The shaft is secured to the burn basket and renders the burn basket rotatable therewith. A closed housing is connected to an end of the conduit remote from the end in the burn chamber. A fan is provided for delivering a volume of air to the closed housing and thence to the conduit. A pelletized fuel feeding apparatus is provided for delivering pelletized fuel from a storage device to the closed housing, the inclined relation of the conduit causing the pelletized fuel to move from the closed housing down the conduit under the influence of gravity and drop into the burn basket. A control arrangement is provided for driving the burn basket for rotation and for regulating the volume of air delivered to the conduit and thence to the burn chamber and for regulating the volume of pelletized fuel per unit of time also to the conduit. The air serves the purpose of providing the requisite support for sustained ignition and burning of the pelletized fuel in the burn basket as well as preventing a backfiring or burning of the pelletized fuel in the conduit.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figure 1:
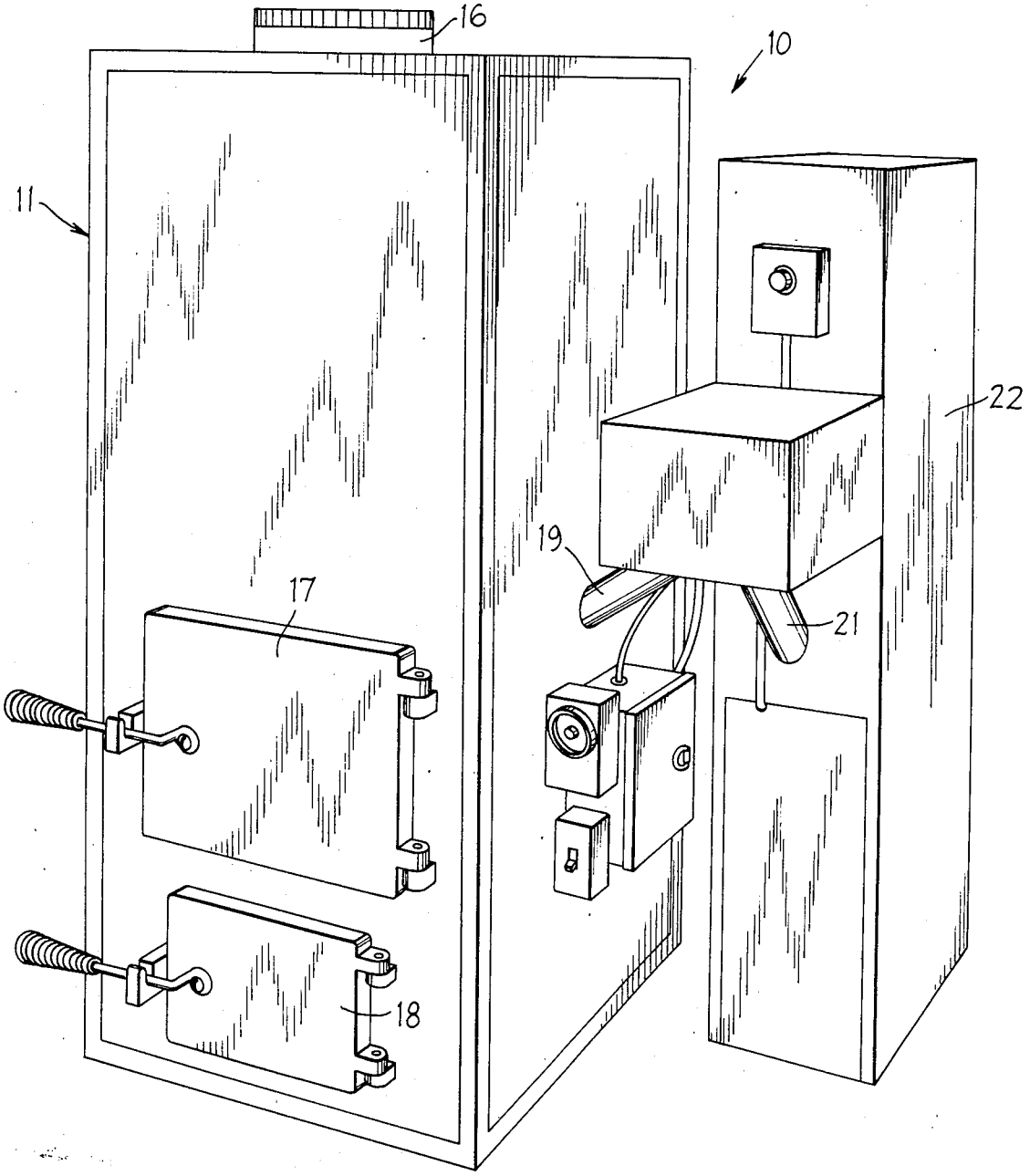
FIG. 1 is a perspective view of a pellet burning system, namely, a furnace, a fuel storage bin and delivery apparatus associated therewith.
Figure 2:
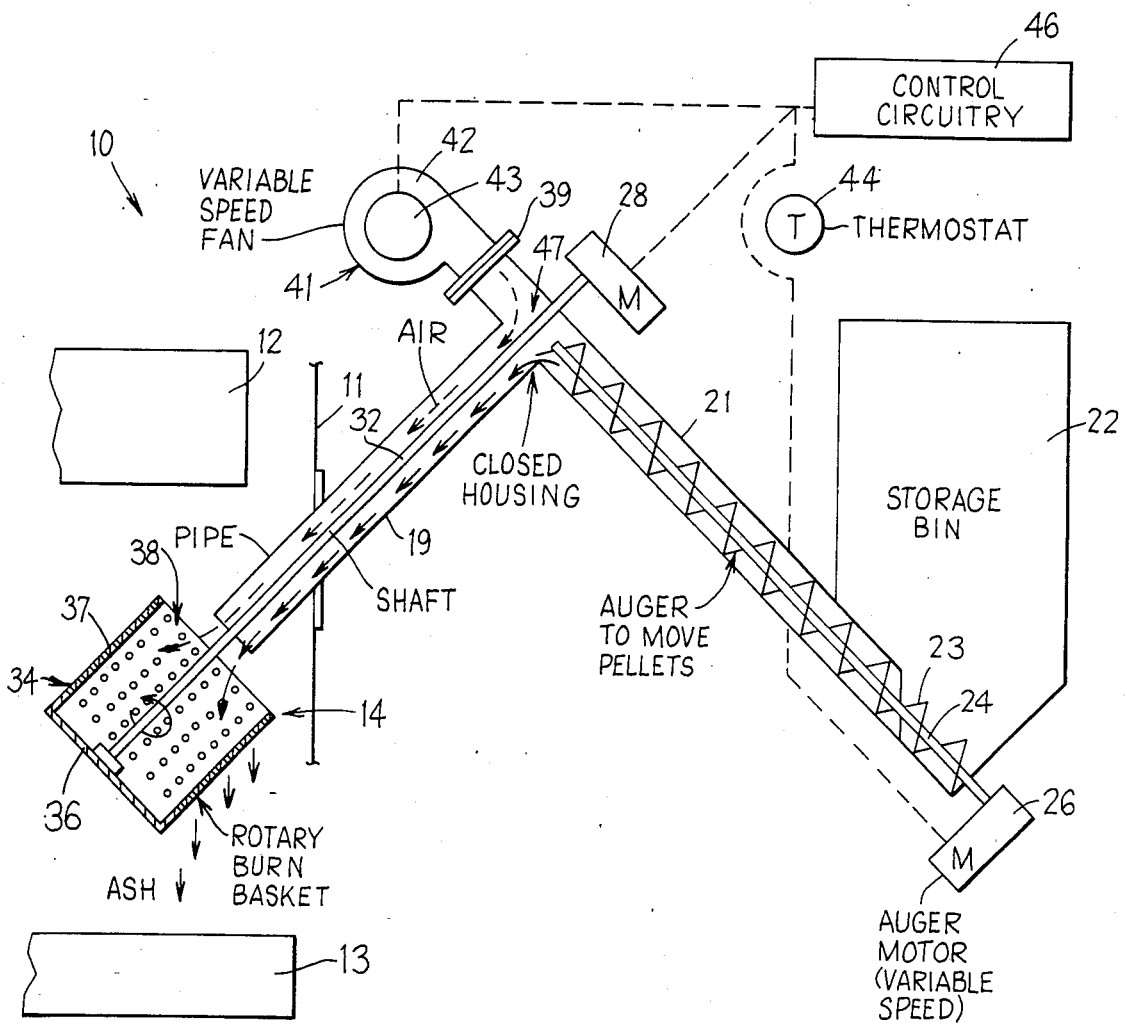
FIG. 2 is a schematic drawing of the system embodied in my pellet burning system.
Figure 3:
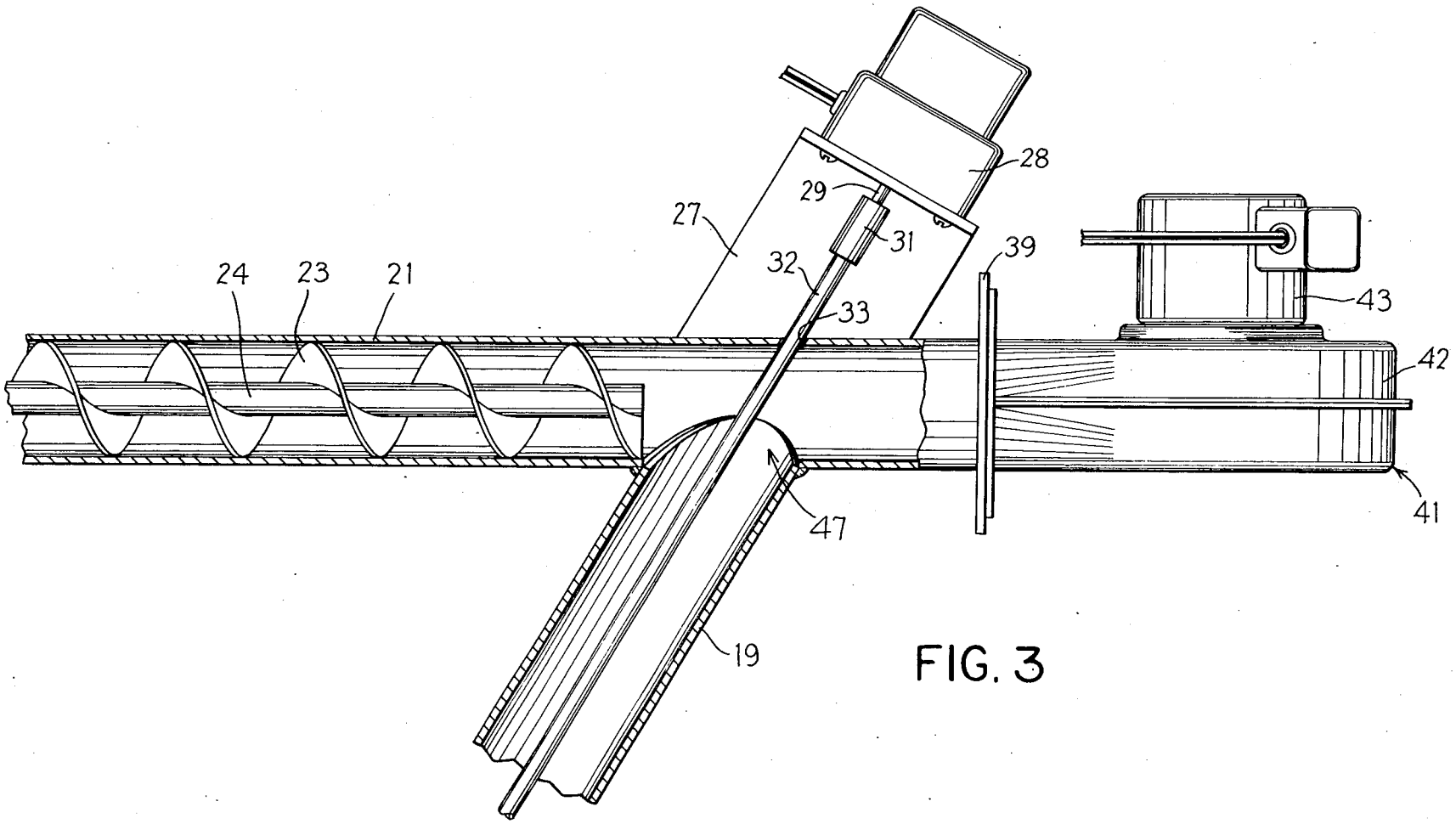
FIG. 3 is an enlarged, partially sectioned, view of the closed housing intermediate the fuel storage bin and feeding apparatus and the conduit leading to the burn basket.

A pellet burning system 10 embodying my invention is illustrated in FIGS. 1 and 2. The pellet burning system 10 includes a furnace housing 11 having inside thereof a conventional type of heat exchanger 12, an ash collecting bin 13 and a burn chamber 14 intermediate the heat exchanger 12 and the ash bin 13. The heat exchanger is oriented in heat exchanging relation to the burn chamber and is located intermediate the burn chamber and a flue 16 which allows the exhaust gases produced by ignition and burn to exit the furnace housing. A door 17 is hingedly mounted on one face of the furnace 11 and allows access to the burn chamber 14. Another door 18 is hingedly supported on the same face of the furnace housing 11 immediately below the door 17 and provides access to the ash bin 13.

A conduit 19 extends through a wall of the furnace housing 11 and terminates at one end thereof in the burn chamber 14. The conduit 19 is inclined to the horizontal extending upwardly from the burn chamber 14 at an angle of approximately 45°. The angle of inclination can vary but the optimum angle has been found to be in the range of 40° to 60°. The end of the conduit 19 remote from the end terminating in the burn chamber 14 is connected to a further conduit 21. The further conduit 21 extends to and is connected in feeding relation to a pelletized fuel storage bin 22. In this particular embodiment, the conduit 21 extends inclined to the horizontal with the storage bin 22 being connected in feeding relation to the conduit 21 adjacent the lower end of the conduit 21 as illustrated in FIG. 2. An auger 23 is oriented in the conduit 21 and the shaft 24 thereof is rotatably driven by a variable speed auger motor 26. As illustrated in FIG. 2, the auger extends lengthwise of the conduit 21 up to the location whereat the conduit 19 is secured to the conduit 21.

A support bracket 27 is secured to the exterior of the conduit 21 and has fixedly mounted thereon a drive motor 28. The output shaft 29 of the drive motor 28 is connected by a coupler 31 to an elongated drive shaft 32 which extends through an opening 33 in the wall of the conduit 21 and along the length of the conduit 19. In this particular embodiment, the axis of the shaft 32 is coaxial with the longitudinal axis of the conduit 19. The shaft 32 extends into the burn chamber 14 as illustrated in FIG. 2 and has fixedly secured thereto a rotary burn basket 34.

The rotary burn basket 34 has a bottom wall 36 and a perforate side wall 37 fixedly secured to the bottom wall and extending away therefrom. In this particular embodiment, the side wall 37 is of a cylindrical configuration, the bottom wall 36 closing off one end thereof, the opposite end being open as at 38 (FIG. 2). The end of the conduit 19 terminating in the burn chamber 14 is oriented above the open end 38 of the rotary burn basket 34. If desired, a section of pipe can be weldably secured to the bottom wall 36 and extend on an axis of the rotary burn basket 34 up toward the terminal end of the conduit 19 whereat it is sleeveably received over the end of the shaft 32 and be secured thereto by any conventional means. This structure is not illustrated but is a readily acceptable alternate construction from that illustrated in FIG. 2.

The end of the conduit 21 remote from the storage bin 22 is flanged as at 39 and has secured thereto a fan mechanism 41 consisting of a blower housing 42 and a drive motor 43 therefor.

A conventional thermostat 44 is located in a region which is to be heated by the pellet burning system 10. The thermostat 44 monitors the temperature within the region. When the temperature falls below the set value on the thermostat, control circuitry 46 is activated to energize the auger motor 26 to cause the supply of pelletized fuel from the storage bin 22 to the conduit 21. The pelletized fuel, upon reaching the conduit 19, will fall under the influence of gravity down along the length of the conduit 19 and into the rotary burn basket 34. The region whereat the pelletized fuel enters the conduit 19 defines what is hereinafter referred to as a closed housing 47. The fan mechanism 41 supplies air to the closed housing 47 and due to the pelletized fuel in the conduit 21, an air lock is formed preventing air movement along the length of the conduit 21 toward the storage bin 22. As a result, air movement generated by the fan mechanism 41 will travel along the length of the conduit 19 and into the burn chamber 14. Due to the close relationship of the end of the conduit 19 in the burn chamber 14 to the open end 38 of the rotary burn basket, the air will be directed onto the burning mass of fuel in the rotary burn basket to sustain ignition and burning of the pelletized fuel therein.

OPERATION

Although the operation of the pellet burning system will be apparent to those of ordinary skill in this particular art area, a brief discussion will be given for convenience.

Initially, all of the drive motors for the pellet burning system are to be turned off. Next, several large handfulls of pellets or corn are to be placed into the burn basket. Charcoal lighter fluid, for example, can be poured onto the pellets or corn and allowed to soak for several minutes. Thereafter, the pellets can be ignited by lighting a fire and letting the pellets or corn burn for several minutes or until a small bed of coals are established. Thereafter, the fan mechanism 41 is activated by turning on the motor 43 thereon to cause air to flow down through the conduit 19 and into the burn chamber 14 to provide the requisite volume of air to support ignition and burning. Initially, the blower speed should be relatively slow so that a low volume of air is supplied thereto until a good bed of coals are formed. Thereafter, the blower speed can be increased to a high speed. Thereafter, the auger motor 26 can be activated for purposes of feeding pelletized fuel from the storage bin 22 along the length of the conduit 21 and allowing same to drop down along the length of the conduit 19 and into the burn chamber 14 and thence the rotary burn basket 34. Simultaneously therewith, the motor 28 is activated to effect a rotating of the burn basket 34.

Thus, and once adequate ignition of the pellets has occurred and the auger motor 26 has been activated, the pellets or corn are fed into the burn chamber 14 at a controlled rate. With the proper amount of air supplied to the burn chamber through the conduit 19, the pelletized fuel will be consumed at an even rate. The only adjustments necessary may be in the volume of air delivered by the fan mechanism 41 and this can be controlled by a conventional control circuit. In most cases, however, a maximum air setting will provide the best results. In addition, the auger motor 26 can be controlled so that the speed thereof or the time interval during which it is energized will supply pelletized fuel at a sufficient rate to maintain a good bed of coals in the rotary burn basket 34.

In this particular embodiment, the rotary burn basket is rotated at 1 rpm. The holes provided in the rotary burn basket allow for the ash from the spent fuel to exit through the holes and drop into the ash bin 13.

As stated above, the temperature in the region to which heat is supplied is controlled by a thermostat. When the thermostat calls for heat, the auger motor 26 will run continuously until the thermostat is satisfied. At this time, a cycle timer in the control circuitry 46 will operate the auger motor 26. The timer will periodically turn the auger motor 26 on for a preselected interval of time to effect a feeding of a selected amount of fuel to the rotary burn basket. The purpose of the cycle timer is to maintain a fire in the rotary burn basket when the thermostat is satisfied. The cycle is adjustable from 0 to 90% of ON time and 0 to 100% of OFF time. In milder weather conditions, shorter ON periods may be desirable and as the weather becomes colder, longer ON periods may be more suitable. If the time interval for an ON period is too short, insufficient fuel may be supplied to the rotary burn basket 34 and may cause the fire to go out.

When the ash bin is full, it is necessary to remove and empty the ashes into a safe container. Failure to clean out the ash bin will eventually lead to a buildup of ash within the burn chamber 14 and hinder the furnace operation and efficiency.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus for burning pelletized fuel, comprising:

a furnace housing means having a heat exchanger means, an exhaust gas flue means and an ash collecting bin therein;

a burn chamber in said housing above said ash collecting bin, said heat exchanger means being oriented in heat exchanging relation to said burn chamber and intermediate said burn chamber and said flue means;

a conduit extending through a wall of said housing means and terminating at an end in said burn chamber, said conduit being inclined to the horizontal;

shaft means and means for supporting said shaft means for rotation;

a burn basket in said burn chamber and having a bottom wall, a perforate side wall and an open top, said end of said conduit in said burn chamber terminating adjacent said open top and spaced from said bottom wall;

means for securing said shaft means to said burn basket and for rotation with said shaft means;

drive means for driving said shaft means for rotation;

a closed housing means connected to an end of said conduit remote from said end in said burn chamber;

a fan means for delivering air to said closed housing means and thence to said conduit;

a storage means for storing pelletized fuel;

a pelletized fuel feeding means for delivering said pelletized fuel from said storage means to said closed housing means, said inclined relation of said conduit causing said pelletized fuel to move from said closed housing means down said conduit under the influence of gravity and drop into said burn basket; and control means for regulating the volume of air delivered to said conduit and thence said burn chamber and for regulating the volume of pelletized fuel per unit of time also to said conduit, said air serving to provide the requisite support for sustained ignition and burning of said pelletized fuel in said burn basket as well as preventing a backfiring or burning of said pelletized fuel in said conduit.

2. An apparatus according to claim 1, wherein said bottom wall is oriented generally perpendicular to a longitudinal axis of said conduit.

3. An apparatus according to claim 2, wherein said shaft means extends through said conduit means.

4. An apparatus according to claim 3, wherein said burn basket has a cylindrical side wall, said bottom wall being flat and oriented in a plane perpendicular to the central axis of said cylindrical side wall.

5. An apparatus according to claim 4, wherein the axis of rotation of said shaft means and said central axis of said cylindrical side wall are coaxial; and wherein connecting means are provided for connecting said bottom wall to said shaft means.

* * * * *